US008169382B2

(12) United States Patent
Kasai

(10) Patent No.: US 8,169,382 B2
(45) Date of Patent: May 1, 2012

(54) ELECTRO-OPTICAL DEVICE, DRIVING CIRCUIT THEREOF, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1002 days.

(21) Appl. No.: 11/423,369

(22) Filed: Jun. 9, 2006

(65) Prior Publication Data

US 2007/0001659 A1 Jan. 4, 2007

(30) Foreign Application Priority Data

Jul. 4, 2005 (JP) ..... 2005-194640

(51) Int. Cl.
*G09G 3/20* (2006.01)

(52) U.S. Cl. ..... 345/55

(58) Field of Classification Search ..... 345/55, 345/76–78; 323/315, 312; 315/169.3
See application file for complete search history.

(56) References Cited

U.S. PATENT DOCUMENTS

| | | | | |
|---|---|---|---|---|
| 6,747,417 | B2 * | 6/2004 | Meade et al. | 315/169.3 |
| 7,180,513 | B2 * | 2/2007 | Tsuge | 345/211 |
| 7,477,094 | B2 | 1/2009 | Date et al. | |
| 2002/0075208 | A1 * | 6/2002 | Bae et al. | 345/76 |
| 2004/0036684 | A1 * | 2/2004 | Kasai | 345/204 |
| 2004/0227499 | A1 * | 11/2004 | Date et al. | 323/315 |
| 2005/0030273 | A1 * | 2/2005 | Shih et al. | 345/94 |

FOREIGN PATENT DOCUMENTS

| | | | |
|---|---|---|---|
| JP | A 2000-293245 | | 10/2000 |
| JP | A-2003-91261 | | 3/2003 |
| JP | A-2004-271759 | | 9/2004 |
| JP | A-2004-334124 | | 11/2004 |
| JP | 205-049632 | A * | 2/2005 |
| JP | A 2005-049632 | | 2/2005 |
| WO | WO 03/092165 | A1 * | 11/2003 |

* cited by examiner

*Primary Examiner* — Sumati Lefkowitz
*Assistant Examiner* — Jonathan Horner
(74) *Attorney, Agent, or Firm* — Oliff & Berridge, PLC

(57) ABSTRACT

A driving circuit of an electro-optical device having electro-optical elements which are changed to optical states corresponding to data signals includes: a first terminal group and a second terminal group of which each includes an input terminal and an output terminal; a first current generator for generating first reference current corresponding to an input signal to the input terminal of the first terminal group; a second current generator for generating second reference current corresponding to an input signal to the input terminal of the second terminal group; a data signal generator for generating the data signals corresponding to the first reference current and the second reference current; a first output unit for outputting the data signal corresponding to the second reference current to the output terminal of the first terminal group; and a second output unit for outputting the data signal corresponding to the first reference current to the output terminal of the second terminal group.

13 Claims, 11 Drawing Sheets

ELECTRO-OPTICAL DEVICE, DRIVING CIRCUIT THEREOF, AND ELECTRONIC APPARATUS

This application claims priority from Japanese Patent Application No. 2005-194640, filed in the Japanese Patent Office on Jul. 4, 2005, the entire disclosure of which is hereby incorporated by reference in its entirety.

BACKGROUND

1. Technical Field

The present invention relates to controlling behaviors of a variety of electro-optical elements such as light emitting elements represented by organic light emitting diodes (hereinafter, referred to as "OLED").

2. Related Art

As display units or exposing units of a variety of electronic apparatuses, electro-optical devices in which a plurality of electro-optical elements are arranged have been suggested. The gray scales (for example, brightness) of the electro-optical elements are controlled in accordance with data signals supplied to data lines corresponding to the electro-optical elements. A configuration employing a plurality of semiconductor chips or supplying the data signals to a plurality of data lines is also known. In the respective semiconductor chips, data signals corresponding to the gray scales are generated with reference to current (hereinafter, referred to as "reference current") generated from the semiconductor chips.

However, difference in characteristics (for example, threshold voltage) due to manufacturing processes can occur between the semiconductor chips. Accordingly, even when the same gray scale is specified for the electro-optical elements, there is caused a problem that the gray scales of the electro-optical elements are different because the reference current serving as a basis of the data signals is different for the semiconductor chips. In order to solve the problem, a configuration of supplying all the semiconductor chips in common with the reference current generated from one reference current generating circuit is disclosed in JP-A-2000-293245 (see Paragraph No. 0008 and FIG. 1). In addition, a configuration of supplying a signal corresponding to the reference current of each semiconductor chip to a semiconductor chip adjacent thereto for use in generating the data signals is disclosed in JP-A-2005-49632 (see Paragraph No. 0042 and FIG. 2).

However, in the configuration disclosed in JP-A-2000-293245, since wires for electrically connecting the reference current generating circuit to the semiconductor chips are elongated, there is a problem that the reference current supplied to the semiconductor chips from the reference current generating circuit can be easily varied due to a variety of factors such as noise from the peripheral circuits. On the other hand, in the configuration disclosed in JP-A-2005-49632, the reference current is varied accumulatively every time of supplying the reference current to the semiconductor chips due to a variety of factors such as variation in characteristics of the semiconductor chips or superposition of noises in the wires. Accordingly, there is a problem that the reference current supplied to a downstream semiconductor chip in the flow direction of the reference current is further deviated from a predetermined current value.

SUMMARY

An advantage of the present invention is to suppress difference in reference current between driving circuits.

According to an aspect of the invention, there is provided a driving circuit of an electro-optical device having electro-optical elements which are changed to optical states corresponding to data signals, the driving circuit comprising: a first terminal group and a second terminal group of which each includes an input terminal and an output terminal; a first current generator for generating first reference current corresponding to an input signal to the input terminal of the first terminal group; a second current generator for generating second reference current corresponding to an input signal to the input terminal of the second terminal group; a data signal generator for generating the data signals corresponding to the first reference current and the second reference current; a first output unit for outputting the data signal corresponding to the second reference current to the output terminal of the first terminal group; and a second output unit for outputting the data signal corresponding to the first reference current to the output terminal of the second terminal group.

A plurality of the driving circuits having the above-mentioned configuration is arranged adjacent to each other (for example, see Examples shown in FIG. 7) so that the input terminal of the first terminal group of each driving circuit and the output terminal of the second terminal group of another driving circuit are connected electrically to each other and the output terminal of the first terminal group of each driving circuit and the input terminal of the second terminal group of another driving circuit are connected electrically to each other. In this configuration, by supplying a signal corresponding to the reference current in the i-th driving circuit to the input terminal of the first terminal group of the (i+1)-th driving circuit from the output terminal of the second terminal group, the reference current of the (i+1)-th driving circuit is adjusted in accordance with the reference current of the i-th driving circuit. In addition, by supplying a signal corresponding to the reference current in the (i+1)-th driving circuit to the input terminal of the second terminal group of the i-th driving circuit from the output terminal of the first terminal group, the reference current of the i-th driving circuit is adjusted in accordance with the reference current of the (i+1)-th driving circuit (that is, the reference current of the (i+1)-th driving circuit is fed back to the reference current of the i-th driving circuit). In this way, according to the above-mentioned aspect, it is possible to arrange a plurality of driving circuits so that the reference current of each driving circuit is adjusted in accordance with the reference current of the driving circuits disposed on both sides of the driving circuit (that is, so that the reference current is transmitted in both directions of the arrangement of the driving circuits). Accordingly, in comparison with the configuration disclosed in JP-A-2005-49632 in which that reference current is transmitted in only one direction, it is possible to reduce the deviation in reference current between the driving circuits.

In another aspect, a plurality of driving circuits may arranged adjacent to each other so that the output terminal of the second terminal group of each driving circuit is electrically connected to the input terminal of the first terminal of another driving circuit adjacent to the driving circuit in a first direction (for example, see Example 1a and Example 1b of FIG. 6). In this aspect, by supplying the signal corresponding to the reference current in the i-th driving circuit from the output terminal of the second terminal group to the input terminal of the first terminal group of the (i+1)-th driving circuit adjacent thereto in the first direction, the reference current of the (i+1)-th driving circuit can be adjusted in accordance with the reference current of the i-th driving circuit. That is, the reference current of each driving circuits can be sequentially adjusted in the first direction. On the other hand, a plurality of driving circuits may be arranged adjacent to each other so that the imputer terminal of the second terminal group of each driving circuit is electrically connected to the output terminal of the first terminal of another driving circuit adjacent thereto in the first direction (for example, see Example 1b or Example 2b of FIG. 6). In this configuration, the reference current of the respective driving circuits can be sequentially adjusted in the second direction. In this way, it is possible to select the adjustment direction of the reference current in the respective driving circuits depending upon the connection examples thereof. Accordingly, it is possible to enhance the degree of freedom in layout of the driving circuits.

In the invention, the "electro-optical element" is an element of which the optical characteristics such as brightness and light transmittance are varied with supply of electric energy. A typical example of such an electro-optical element according to the invention is a light emitting element represented by an OILED element, but the invention is not limited to it.

Only the first terminal group and the second terminal group are specified in the above-mentioned aspect, but configurations including other terminal groups having an input terminal or an output terminal do not depart from the scope of the invention. Driving circuits having three or more current generators including the first current generator and the second current generator or driving circuits having three or more output parts including the first output part and the second output part do not naturally depart from the scope of the invention. That is, If only two or more sets including a terminal group, a current generator, and an output part are arranged, the configuration is naturally belong to the scope of the invention without necessarily determining existence of other sets, by considering the parts of one set as the "first terminal group", the "first current generator", and the "first output part" and considering the parts of another set as the "second terminal group", the "second current generator", and the "second output part."

In another aspect of the invention, the driving circuit may be integrated on a semiconductor chip (IC chip), the terminals of the first terminal group may be disposed along one edge of each semiconductor chip, and the terminals of the second terminal group may be disposed alone the edges opposed to the one edge. According to this aspect, the plurality of semiconductor chips arranged in the predetermined direction are electrically connected to each other with relatively short wires positioned in the gap between the semiconductor chips. Accordingly, it is possible to suppress deviation in reference current in the semiconductor chips due to superposition of noises in the wires. However, the terminals of the first terminal group or the second terminal group are not necessarily arranged linearly along the edges of the respective semiconductor chips. That is, if only the terminals of the first terminal group are arranged on one side of the data signal generator and the terminals of the second terminal group are arranged on the other side of the data signal generator, it is possible to obtain the advantage that the wires positioned in the gap between the semiconductor chips are shortened regardless of the arrangement type of the terminal groups.

In another aspect of the invention, the first current generator may include a current mirror circuit having a transistor (for example, see the first transistor 41 in FIG. 4) for gene rating first current corresponding to the input signal of the first terminal group and a transistor (for example, see the second transistor 42 in FIG. 4) for generating mirror current of the first current as the first reference current, and the second current generator may include a current mirror circuit having a transistor for generating second current corresponding to the input signal of the second terminal group and a transistor for generating mirror current of the second current as the second reference current.

In this case, the first current generator may include a first voltage generating transistor which is disposed in a path of the first reference current and the gate of which is connected to a reference potential line, the second current generator may include a second voltage generating transistor which is disposed in a path of the second reference current and the gate of which is connected to the reference potential line, and the data signal generator may generate the data signal with reference to the potential (potential Vref in the embodiments) of the reference potential line. According to this aspect, since the potential of the reference potential line is adjusted in accordance with both of the first reference current and the second reference current, it is possible to balance the potential of the reference potential line which serves as a reference for generating the data signal in the respective driving circuits. In addition, the gates of the transistors constituting the current mirror circuit of the first current generator and the gates of the transistors constituting the current mirror circuit of the second current generator may be connected to each other. In this configuration, it is possible to rapidly and surely equalize the first reference current and the second reference current.

According to another aspect of the invention, there is provided an electro-optical device comprising the driving circuits described above. that is, the electro-optical device comprises: a plurality of electro-optical elements which are changed to optical states corresponding to data signals supplied to data lines; a data-line driving circuit in which a plurality of the driving circuits according to any one aspects of the invention described above; and a first wire (for example, one of the first wire L1 and the second wire L2 in FIG. 6 or 7) for connecting the output terminal of the first terminal group of each driving circuit to the input terminal of the second terminal group of another driving circuit adjacent to the driving circuit. According to this aspect, it is possible to obtain the same advantages as the driving circuit according to the invention.

In the electro-optical device, a second wire (for example, the other one of the first wire L1 and the second wire L2 in FIG. 6 or 7, for connecting the input terminal of the first terminal group of each driving circuit to the output terminal of the second terminal group of another driving circuit adjacent to the driving circuit may further provided so that the reference current can be adjusted in both directions along the arrangement of the driving circuits. The specific example thereof is shown in FIG. 7. In addition, in the configuration that the driving circuits are integrated in semiconductor chips, respectively, and the semiconductor chips are arranged in a predetermined direction, the terminals of the first terminal group may be disposed on one end in the predetermined direction of each semiconductor chip and the terminals of the second terminal group may be disposed on the other end in the predetermined direction. According to this configuration, it is possible to electrically connect the driving circuits to each other with the relatively short wires positioned in the gaps between the semiconductor chips.

In another aspect of the invention, a reference setting unit for generating a voltage signal serving as a reference of reference current may be further provided, and the voltage signal generated by the reference setting unit may be supplied to the input terminal of at least one driving circuit of the plurality of driving circuits. In another aspect, a reference setting unit for generating a current signal serving as a reference of reference current may be further provided, and the current signal generated by the reference setting unit may be supplied to the input terminal of at least one driving circuit of the plurality of driving circuits.

The electro-optical device according to the invention can be used in a variety of electronic apparatuses. A typical example of such electronic apparatuses is an apparatus using the electro-optical device as a display unit. Examples of such electronic apparatuses can include a personal computer and a mobile phone. However, the application of the electro-optical device according to the invention is not limited to displaying an image. For example, the electro-optical device according to the invention can be also used as an exposing unit (exposing head) for forming a latent image on an image carrier such as a photosensitive drum by means of irradiation of light.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
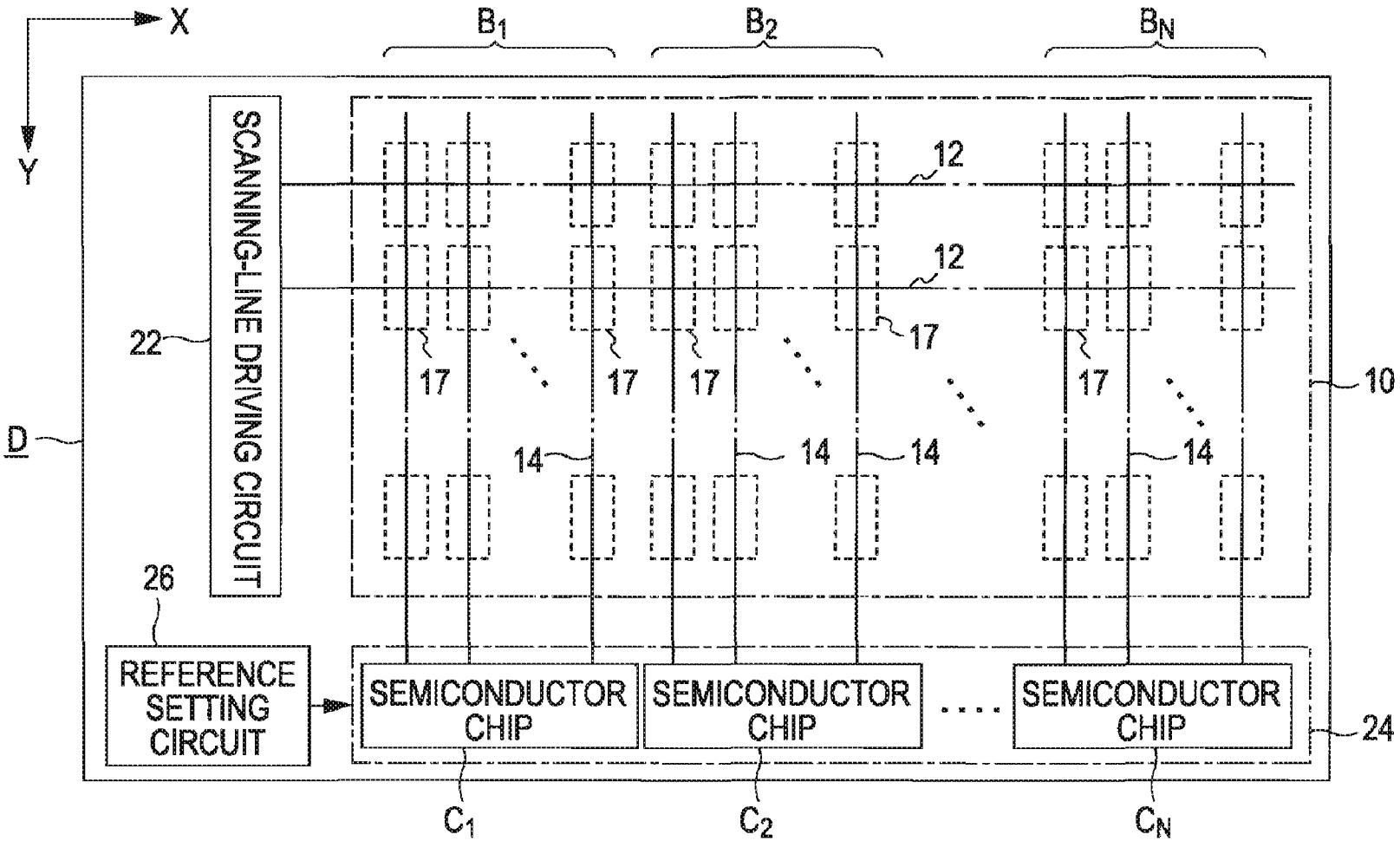
FIG. 1 is a block diagram illustrating a configuration of an electro-optical device according to a first embodiment.

FIG. 1 is a block diagram illustrating a configuration of an electro-optical device according to a first embodiment of the present invention. As shown in the figure, the electro-optical device D has an element array section 10 in which a plurality of electro-optical elements 17 are arranged two-dimensionally, a scanning-line driving circuit 22 and a data-line driving circuit 24 for driving the electro-optical elements 17, and a reference setting circuit 26 for generating signals used for the data-line driving circuit 24.

Figure 2:
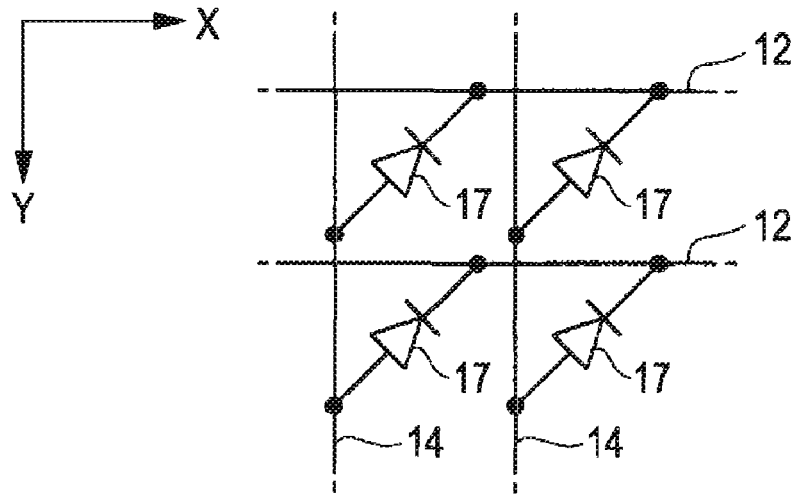
FIG. 2 is a circuit diagram illustrating an example of arrangement of electro-optical elements.

FIG. 2 is an enlarged circuit diagram illustrating a configuration including some electro-optical elements 17. As shown in FIGS. 1 and 2, a plurality of scanning lines 12 extending in the X direction and a plurality of data lines 14 extending In the Y direction are formed in the element array section 10. The electro-optical elements 17 are disposed at positions corresponding to intersections between the scanning-lines 12 and the data lines 14 and are arranged in a matrix shape. The electro-optical elements 17 are OLED elements (light emitting elements) in which a light emitting layer made of an organic electroluminescent (EL) material such as a high molecular or low molecular material or a dendrimer material is interposed between a positive electrode and a negative electrode. As shown in FIG. 2, the electro-optical device D according to the first embodiment is a passive matrix light emitting device in which the positive electrodes of the electro-optical elements 17 are connected to the data lines 14 and the negative electrodes is connected to the scanning lines 12.

Figure 3:
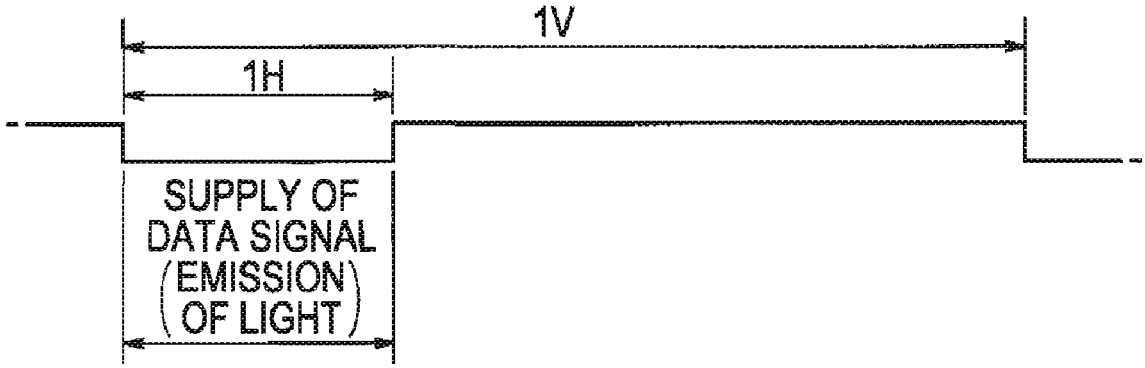
FIG. 3 is a timing diagram illustrating a schematic operation of the electro-optical device.

The scanning-line driving circuit 22 is a circuit for sequentially selecting a plurality of scanning lines 12. As shown in FIG. 3, the potential of the scanning line 12 selected by the scanning-line driving circuit 22 is set to a low level and the potentials of the scanning lines 12 not selected are set to a high level.

As shown in FIG. 1, a plurality of data lines 14 formed in the element array unit 10 are partitioned into N blocks B ($B_1$, $B_2$, . . . , and $B_N$) in a unit of n data lines (where n and N are all natural numbers). The data-line driving circuit 24 includes N semiconductor chips C ($C_1$, $C_2$, . . . , and $C_N$) corresponding to individual blocks B. The semiconductor chips C have a rectangular two-dimensional outline and are arranged in the X direction with their major edges directed to the X direction. The semiconductor chips C adjacent to each other are electrically connected to each other and specific examples of connections thereof are described later.

Figure 4:
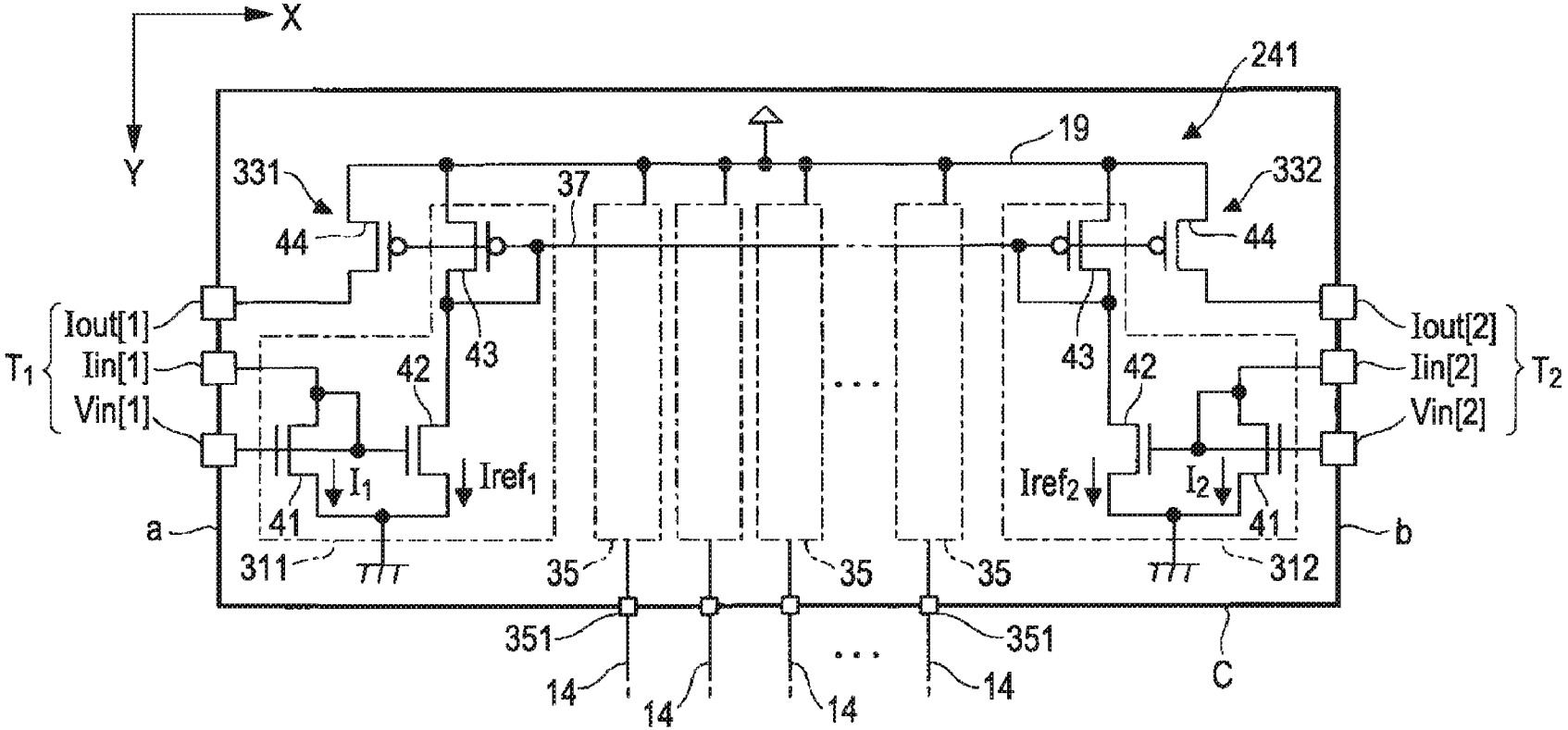
FIG. 4 is a circuit diagram illustrating a configuration of a driving circuit mounted on a semiconductor chip.

Next, FIG. 4 is a block diagram illustrating a configuration of each semiconductor chip C (each of $C_1$ to $C_N$). In the figure, only one semiconductor chip C is illustrated, but all the semiconductor chips C ($C_1$ to $C_N$) constituting the data-line driving circuit 24 have the same configuration.

As shown in FIG. 4, each semiconductor chip C includes a driving circuit 241 for outputting data signals to the data lines 14 of the corresponding block B. The data signal output to each data line 14 is a current signal corresponding to the gray scale of the electro-optical element 17 corresponding to an intersection between the scanning line 12 selected by the scanning-line driving circuit 22 and the data line 14. The gray scales of the electro-optical elements 17 are specified by gray-scale data G supplied from the outside. As shown in FIG. 3, the electro-optical elements 17 selected by the scanning-line driving circuit 220 in a horizontal scanning period emit light with brightness corresponding to the data signals supplied through the data lines 14 in the horizontal scanning period.

As shown in FIG. 4, the driving circuit 241 includes a first terminal group T1, a second terminal, group $T_2$, a first current generator 311, a second current generator 312, a first output part 331, a second output part 332, and n data signal generators 35 corresponding to the total number of data lines 14 belonging to one block B.

The first terminal group $T_1$ includes a voltage input terminal Vin[1], a current input terminal Iin[1], and a current output terminal Iout[1]. Similarly, the second terminal group $T_2$ includes a voltage input terminal Vin[2], a current input terminal Iin[2], and a current output terminal Iout[2]. The voltage input terminals Vin[1] and Vin[2] are terminals which are supplied with voltage signals from the outside (a reference setting circuit 26 or another semiconductor chip C), and the current input terminals Iin[1] and Iin[2] are terminals which are supplied with current signals from the outside. On the other hand, the current output terminals Iout[1] and Iout[2] are terminals for outputting current signals to the outside (other semiconductor chips). As shown in FIG. 4, the terminals belonging to the first terminals group $T_1$ are arranged along one short edge a of the rectangular semiconductor chip C. On the other hand, the terminals belonging to the second terminal group $T_2$ are arranged along the short edge b opposite to the short edge a. Accordingly, the first terminal group $T_1$ of the j-th semiconductor chip Cj (where j is an integer satisfying $1 \leqq j \leqq N$) is adjacent to the second terminal group $T_2$ of the semiconductor chip Cj−1 which is adjacent thereto on the minus side in the X direction, and the second terminal group $T_2$ of the semiconductor chip Cj is adjacent to the first terminal group $T_1$ of the semiconductor chip Cj+1 which is adjacent thereto on the plus side in the X direction.

The first current generator 311 and the second current generator 312 are circuits for generating reference current Iref (Iref1 and Iref2) which serves as a reference for current values of the data signals. Each of the first current generator 311 and the second current generator 312 includes a first transistor 41 and a second transistor 42 which are n-channel transistors and a voltage generating transistor 43 which is a p-channel transistor. The gate and the drain of the first transistor 41 are connected to each other. The sources of the first transistor 41 and the second transistor 42 are grounded together. The gates of the first transistor 41 and the second transistor 42 are connected to each other, thereby forming a current mirror circuit. On the other hand, the gate and the drain of the voltage generating transistor 43 are connected to the drain of the second transistor and the source thereof is connected to a power supply line 19. The power supply line 19 is supplied with a high potential or a power source. The gates of the voltage generating transistors 43 of the first current generator 311 and the second current generator 312 are connected in common to a reference potential line 37.

The voltage input terminal Vin[1] of the first terminal group T1 is connected to the gate of the first transistor 41 included in the first current generator 311 and the current input terminal Iin[1] of the first terminal group T1 is connected to the drain of the first transistor 41. Accordingly, current I1 corresponding to the voltage signal supplied to the voltage input terminal Vin[1] or the current signal supplied to the current input terminal Iin[1] flows in the first transistor 41 of the first current generator 311. Mirror current (for example, current equal to the current I1) corresponding to the current I1 flows as the reference current Iref1 in the voltage generating transistor 43 and the second transistor 42 of the first current generator 311.

The relations between the terminals of the second terminal group T2 and the second current generator 312 are similar thereto. Accordingly, current I2 corresponding to the signal supplied to the voltage input terminal Vin[2] or the current input terminal Iin[2] of the second terminal group T2 flows in the first transistor 41 and the reference current Iref2 which is mirror current of the current I2 flows in the voltage generating transistor 43 and the second transistor 42 of the second current generator 312. In this way, since the reference current Iref1 flows in the voltage generating transistor 43 of the first current generator 311 and the reference current Iref2 flows in the voltage generating transistor 43 of the second current generator 312, the reference potential line 37 has a potential Vref corresponding to the reference current Iref1 and the reference current Iref2.

Figure 5:
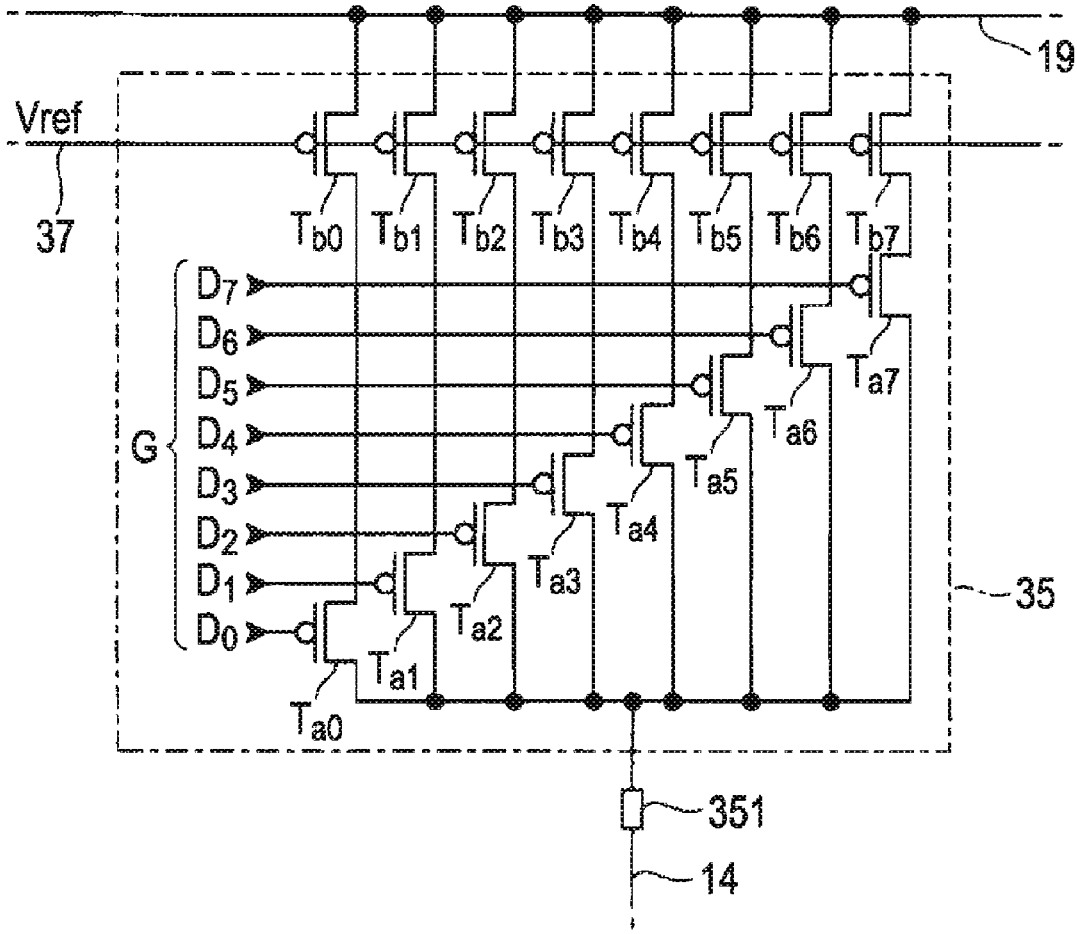
FIG. 5 is a circuit diagram illustrating a configuration of a data signal generator.

Each data signal generator 35 shown in FIG. 4 is a circuit for generating the data signal with the current value corresponding to the gray scale specified by the gray-scale data G (8-bit digital data in the first embodiment) and outputting the data signal to the corresponding data line 14 from a data output terminal 351. As shown in FIG. 5, each data signal generator 35 in the first embodiment is a D/A converter having 8 transistors Ta (Ta0 to Ta7) corresponding to the number of bits of the gray-scale data G and 8 transistors Tb (Tb0 to Tb7) of which the drains are connected to the sources of the transistors Ta, respectively.

The gates of the transistors Ta0 to Ta7 are supplied with the bits (D0 to D7) of the gray-scale data G, respectively. The drains of the transistors Ta0 to Ta7 belonging to one data signal generator 35 are connected in common to the data line 14 through the data output terminal 351. On the other hand, the sources of the transistors Tb are connected to the corresponding power supply line 19 and the gates thereof are connected in common to the reference potential line 37. Accordingly, the current corresponding to the potential Vref of the reference potential line 37 flows in the transistors Tb. The characteristics (specifically a gain coefficient of the transistors Tb0 to Tb7 are selected so that the current flowing in the transistors Tb forms a ratio corresponding to powers of 2 (Tb0:Tb1:Tb1:Tb1:Tb1:Tb1:Tb1:Tb1=1:2:4:8:16:32:64:128) when the common potential Vref is supplied to the gates thereof.

In the configuration described above, the transistors Ta corresponding to the gray-scale data G among the 8 transistors Ta0 to Ta7 are selectively turned on. The current flows in one or more transistors Tb corresponding to the transistors Ta turned on in this way. The current signal corresponding to the addition of the current is output as the data signal to the data line 14 from the data output terminal 351. Since the current of the transistors Tb is determined on the basis of the potential Vref of the reference potential line 37, the data signal generated by the data signal generator 35 has the current value corresponding to the potential Vref.

Each of the first output part 331 and the second output part 332 includes a p-channel transistor 44. The source of the transistor 44 of the first output part 331 is connected to the power supply line 19 and the drain thereof is connected to the current output terminal Iout[1] of the first terminal group T1. Similarly, the source of the transistor 44 of the second output part 332 is connected to the power supply line 19 and the drain thereof is connected to the current output terminal Iout[2] of the second terminal group T2. The gates of the transistors 44 are connected in common to the reference potential line 37. Accordingly, the current signal corresponding to the potential Vref is output to the current output terminal Iout[1] through the first output part 331. Similarly, the current signal corresponding to the potential Vref is output to the current output terminal Iout[2] through the second output part 332.

In the configuration described above, the reference current Iref1 corresponding to the current signal to the current input terminal Iin[1] of the first terminal group T1 or the voltage signal to the voltage input terminal Vin[1] is generated by the first current generator 311, and the potential Vref corresponding to the reference current Iref1 is supplied to the reference potential line 37. The potential Vref is used as a reference for the data signal in the respective data signal generators 35. In addition, since the potential Vref is supplied to the gate of the voltage generating transistor 43 of the second current generator 312, the reference current Iref2 corresponding to the potential Vref flows in the second transistor 42 right below and the current signal corresponding to the potential Vref is output from the current output terminal Iout[2] of the second terminal group T2 through the transistor 44 of the second output part 332. In this way, in the semiconductor chip C according to the first embodiment, the reference current Iref1 corresponding to the input signal to the input terminals Iin[1] or Vin[1] of the first terminal group T1 is first generated, the data signal corresponding to the reference current Iref1 is second generated and output, and the current signal corresponding to the reference current Iref1 (corresponding to the reference current Iref2 generated from the reference current Iref1) is third output externally from the current output terminal Iout[2] of the second terminal group T2. The same is true in the case that the current signal is input to the current input terminal Iin[2] of the second terminal group T2 or the voltage signal is input to the voltage input terminal Vin[2]. That is, in this case, the reference current Iref2 corresponding to the input signal to the second terminal group T2 is first generated, the data signal corresponding to the reference current Iref2 is second generated and output, and the current signal corresponding to the reference current Iref2 (and the reference current Iref1) is third output externally from the current output terminal Iout[1] of the first terminal group T1.

The reference setting circuit shown in FIG. 1 is a circuit for supplying a signal specifying the potential Vref of the reference potential line 37 to at least one semiconductor chip C (hereinafter, referred to as "master chip"). As the reference setting circuit 26 according to the first embodiment, any one of a type (hereinafter, referred to as "voltage output type") for supplying the master chip with the voltage signal serving as a reference of the potential Vref and a type (hereinafter, referred to as "current output type") for supplying the master chip with the current signal serving as a reference of the potential Vref is selected and employed at the time of design. Hereinafter, the semiconductor chips C other than the master chip among the N semiconductor chips C1 to CN constituting the data-line driving circuit 24 are referred to as "slave chips."

B: Examples of Arrangement and Connection of the Semiconductor Chips C

The data-line driving circuit 24 shown in FIG. 1 has such a configuration that a plurality of semiconductor chips C described above is connected to each other. For example, by arranging and connecting the semiconductor chips C as in examples shown in FIG. 6 or 7, the data-line driving circuit 24 is constructed. The actual configuration of the data-line driving circuit 24 can be properly selected from the examples described below or other examples, on the basis of a variety of factors such as layouts or sizes of the respective units of the electro-optical device D, positions of terminals (not shown) for connecting the electro-optical device D to the outer devices, and the fact whether the reference setting circuit 26 is of a voltage output type or of a current output type.

Example 1

Figure 6:
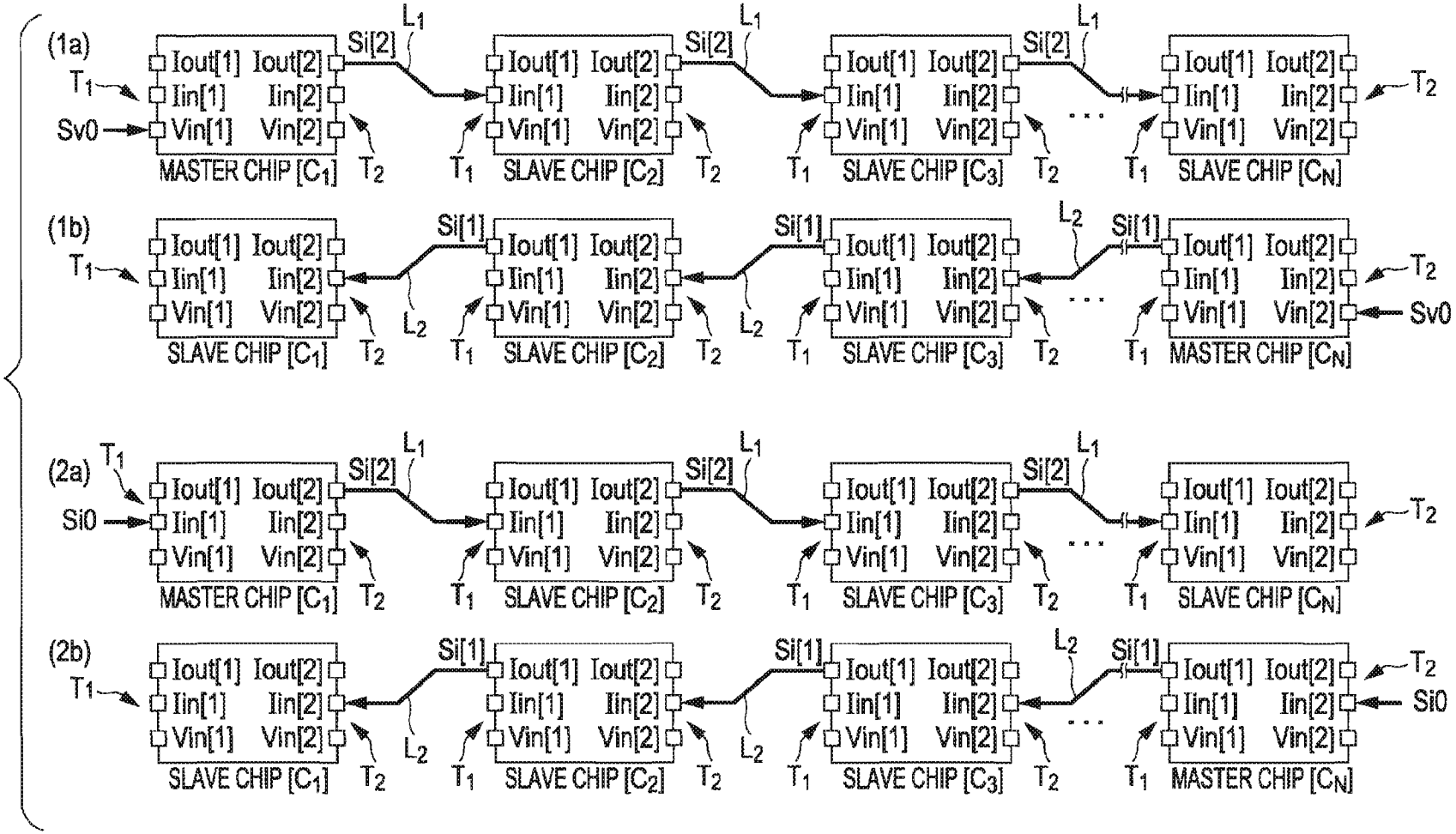
FIG. 6 is a circuit diagram illustrating an example of arrangement of the semiconductor chips.

Examples 1a and 1b shown in FIG. 6 illustrates configurations of the data-line driving circuit 24 when the reference setting circuit 26 is of a voltage output type. In Example 1a, the current output terminal Iout[2] of the second terminal group T2 of each semiconductor chip Cj and the current input terminal Iin[1] of the first terminal group T1 of the semiconductor chip Cj+1 adjacent to the plus side in the X direction are connected to each other through a first wire L1. The semiconductor chip C1 positioned on the most minus side in the X direction serves as a master chip by inputting a voltage signal Sv0 from the reference setting circuit 26 to the voltage input terminal Vin[1]. In the master chip, after the reference current Iref1 and the potential Vref corresponding to the voltage signal Sv0 are generated, a data signal is generated with reference to the potential Vref and a current signal Si[2] corresponding to the potential Vref is supplied to the current input terminal Iin[1] of the subsequent-stage slave chip (semiconductor chip C2) from the current output terminal. Iout[2].

On the other hand, in the slave chips, the potential Vref and the reference current Iref1 corresponding to the current signal Si[2] input from the previous-stage semiconductor chip C are generated, and the data signal and the current signal Si[2] corresponding to the potential Vref are output. That is, the current signal Si[2] serving to determine the reference current Iref1 of the semiconductor chip C (slave chip) is sequentially transmitted to the semiconductor chips C from the minus side in the X direction to the plus side. According to the configuration described above, in comparison with the configuration disclosed in JP-A-2000-293245, since the wire (the first wire L1) between the semiconductor chips C are shortened, it is possible to suppress variation in the reference current Iref1 due to noises in the wires connecting the semiconductor chips C.

In Example 1b, the semiconductor chip CN on the most plus side in the X direction serves as the master chip with supply of the voltage signal Sv0 from the reference setting circuit 26' The current signal Si[1] output from the current output terminal. Iout[1] of the semiconductor chips Cj in accordance with the reference current Iref2 is input to the current input terminal Iin[2] of the semiconductor chip Cj−1 positioned on the minus side in the X direction through a second wire L2. That is, in Example 1b, on the contrary to Example 1a, the current signal Si[1] serving to determine the potential Vref is sequentially transmitted from the plus side in the direction to the minus side.

As described above, by the use of the semiconductor chip having the configuration shown in FIG. 4, it is possible to arbitrarily select of the semiconductor chip C serving as a master chip or the transmitting direction the current signal Si (Si[1] or Si[2]) with reference to the examples of the wires. That is, the configuration (Example 1a) that the current signal Si[2] is transmitted to the plus side in the X direction by using the semiconductor chip C1 as a master chip and the configuration (Example 1b) that the current signal Si[1] is transmitted to the minus side in the X direction by using the semiconductor chip CN as a master chip can use in common the semiconductor chips C having the same structure. Accordingly, it is possible to reduce the cost for change in design of the data-line driving circuit 24 and to enhance the degree of freedom in design of the data-line driving circuit 24.

Example 2

Example 2a and Example 2b shown in FIG. 6 show configurations of the data-line driving circuit 24 used when the reference setting circuit 26 is of a current output type. In Example 2a, the semiconductor chip C1 on the most minus side in the X direction serves as a master chip with supply of the current signal Si0 from the reference setting circuit 26. Similarly to Example 1a, the current signal Si[2] is sequentially supplied from the current output terminal Iout[2] of the semiconductor chip Cj to the current input terminal Iin[1] of the semiconductor chip Cj+1 on the plus side in the X direction thereof. On the other hand, in Example 2b, the semiconductor chip CN positioned on the most plus side in the direction serves as the master chip and the current signal Si[1] is transmitted to the minus side in the X direction between the semiconductor chips C adjacent to each other.

As shown in FIG. 6, by using the semiconductor chips C having the configuration shown in FIG. 4, the configuration employing the reference setting circuit 26 which is of a voltage output type and the configuration employing the reference setting circuit 26 which is of a current output type can use in common the semiconductor chips C having the same configuration. From this point of view, according to the first embodiment, It is possible to enhance the degree of freedom in design of the data-line driving circuit 24 without increasing the cost for change in design.

Example 3

Figure 7:
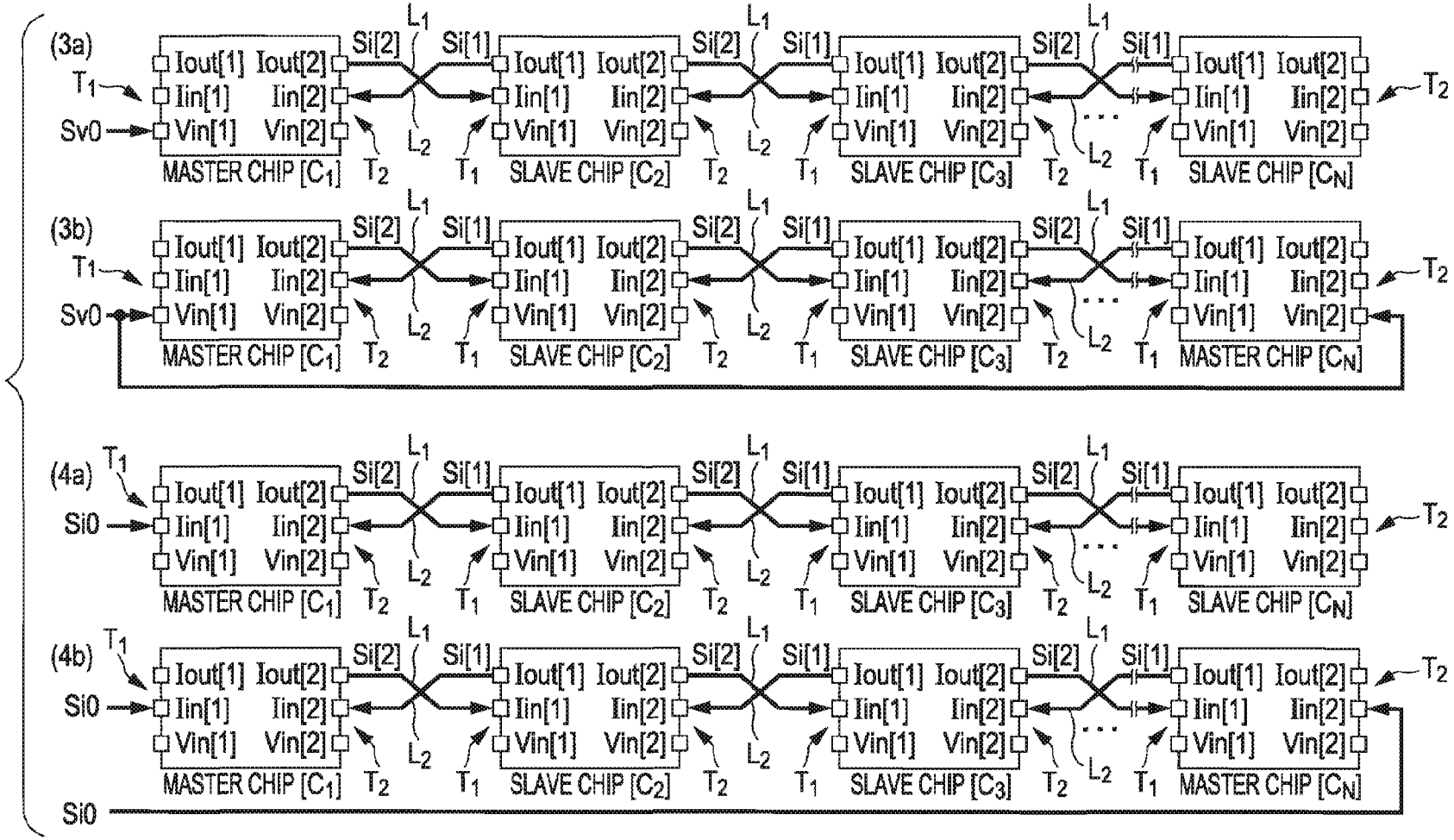
FIG. 7 is a circuit diagram illustrating an example of arrangement of the semiconductor chips.

Example 3a and Example 3b shown in FIG. 7 show configurations of the data-line driving circuit 24 used when the reference setting circuit 26 is of a voltage output type. In Example 3a, the semiconductor chip C1 positioned on the most minus side in the X direction serves as the master chip with supply of the voltage signal Sv0. Paying attention to the semiconductor chip Cj (here, C1 to CN−1) and the semiconductor chip Cj+1 adjacent to the plus side in the X direction thereof, the current output terminal Iout[2] of the semiconductor chip Cj and the current input terminal Iin[1] of the semiconductor chip Cj+1 are connected to each other through the first wire L1, and the current input terminal Iin[2] of the semiconductor chip Cj and the current output terminal Iout[1] of the semiconductor chip Cj+1 are connected to each other through the second wire L2.

Therefore, in the respective semiconductor chips Cj, the reference current Iref1 corresponding to the current signal Si[2] (the voltage signal Sc0 supplied from the reference setting circuit 26 as to the semiconductor chip C1) supplied to the previous-stage semiconductor chip Cj−1 is generated, and the reference current Iref2 corresponding to the current signal Si[1] supplied from the subsequent-stage semiconductor chip Cj+1 is generated. That is, in this examples, the current signal Si[2] corresponding to the reference current Iref1 of the semiconductor chip Cj serves as a basis of the reference current Iref1 of the subsequent-stage semiconductor chip Cj+1, and the current signal Si[1] output from the semiconductor chip Cj+1 is fed back for generating the reference current Iref2 of the semiconductor chip Cj. Here, when the characteristics of the semiconductor chips C are different from each other, the reference current Iref1 and the reference current Iref2 can be varied due to different in current value between the current signal Si[1] and the current signal Si[2] supplied to one semiconductor chip Cj. Even in this case, since the potential Vref of the reference potential line 37 is gradually balanced to the level corresponding to the reference current Iref1 and the reference current Iref2, is possible to suppress the variation in potential Vref in the semiconductor chips C. That is, in the configuration disclosed in JP-A-2005-49632 in which the reference current is transmitted in only one direction, the deviation of the reference current is increased accumulatively every time of transmission, but in the first embodiment, the potential Vref is adjusted in both directions of the arrangement of the driving circuit 241. Accordingly, it is possible to equalize the potential Vref of the semiconductor chips C and thus to suppress deviation in gray scale of the element array unit 10.

On the other hand, as shown as Example 3b in FIG. 7, a configuration that the common voltage signal Sv0 is supplied from the reference setting circuit 26 to the voltage input terminal Vin[1] of the semiconductor chip C1 on the most minus side in the X direction and the voltage input terminal Vin[2] of the semiconductor chip CN on the most plus side thereof (that is, a configuration that both semiconductor chips C1 and CN serve as the master chip) may be employed. According to this example, in comparison with Example 3a, it is possible to rapidly and surely stabilize the potential Vref of the reference potential line 37 in the semiconductor chips C to a uniform level.

The configuration that the voltage signal Sv0 is input to the master chip is exemplified in Example 3a, but as shown in Example 4a of FIG. 7, the reference setting circuit 26 which is of a current output type that the current signal Si0 is input to the master chip may be employed in the configuration that the semiconductor chips C are arranged and connected similarly to Example 3a. As shown in Example 4b of FIG. 7, the configuration that the same current signal Si0 is supplied to the semiconductor chips C (C1 and CN) positioned on both ends may be employed. In this way, with the configuration that the current signals Si[1] and Si[2] are input and output in both directions between the semiconductor chips C adjacent to each other, the semiconductor chips having the same configuration can be used, whether the reference setting circuit 26 is of a current output type or of a voltage output type.

C: Modified Examples

The above-mentioned embodiment can be modified in various forms. Specific modified examples are described below. In addition, the modified examples described below may be combined properly.

Modified Example 1

Figure 8:
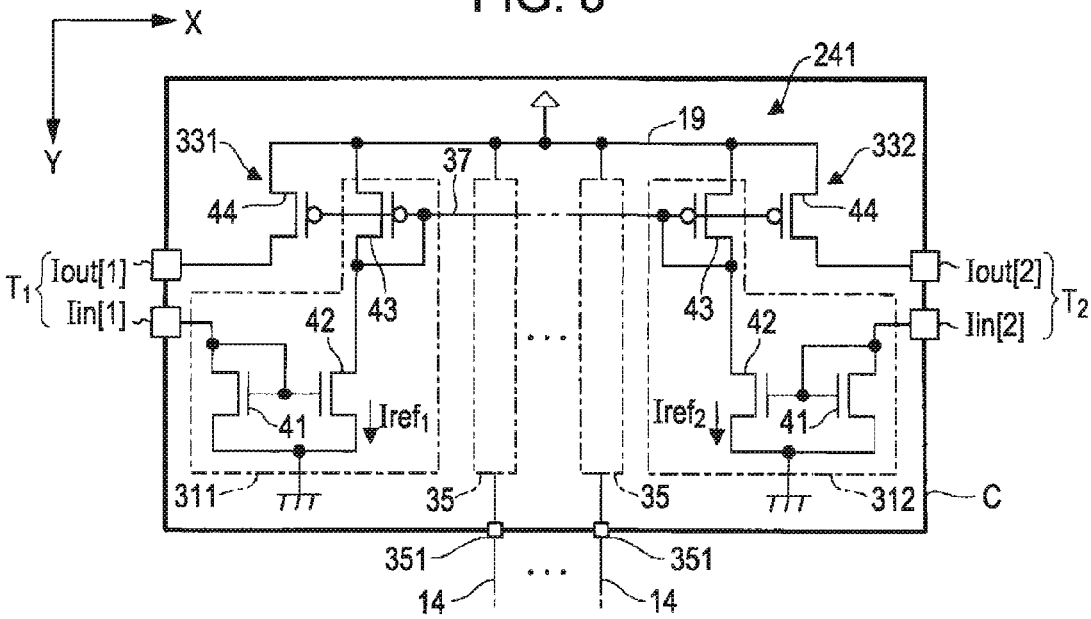
FIG. 8 is a circuit diagram illustrating a configuration of a semiconductor chip according to a modified example.
Figure 9:
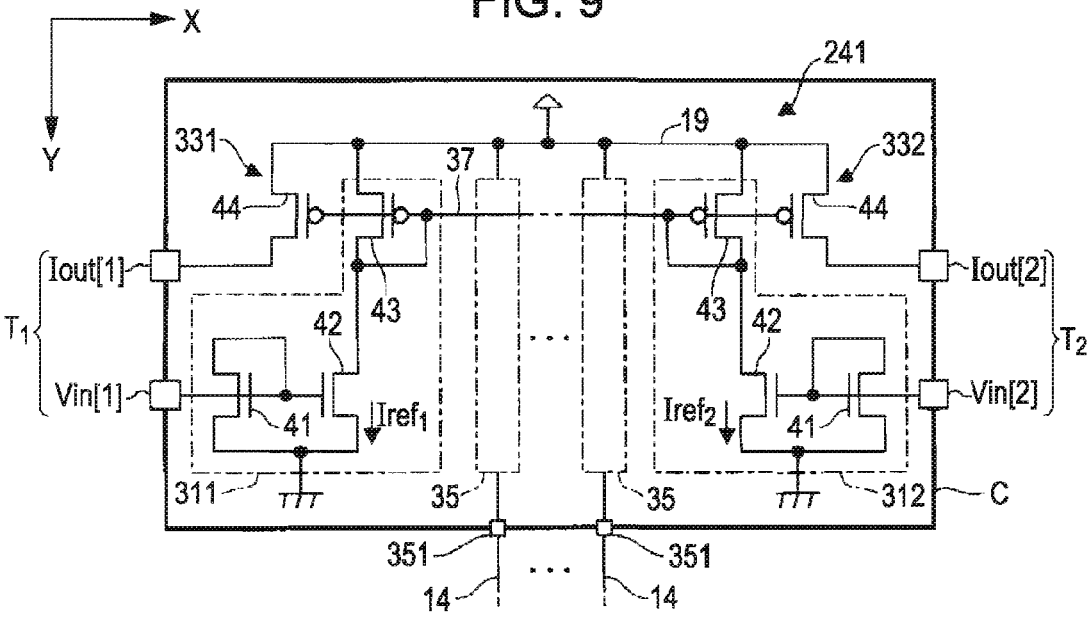
FIG. 9 is a circuit diagram illustrating a configuration of a semiconductor chip according to another modified example.

In the embodiment described above, the configuration that each terminal group T (first terminal group T1 and second terminal group T2) includes the voltage input terminal Vin (Vin[1] or Vin[2]), the current input terminal Iin (Iin[1] or Iin[2]), and the current output terminal Iout (Iout[1] or Iout [2]) has been exemplified, but the terminals constituting the respective terminal groups T are not limited to the example. For example, as shown in FIG. 8, a configuration that each terminal group T includes a current input terminal Iin and a current output terminal Iout (that is, a configuration that the voltage input terminal Vin is omitted from the configuration shown in FIG. 4) may be employed, or as shown in FIG. 9, a configuration that each terminal group T includes a voltage input terminal Vin and a current output terminal Iout (that is, a configuration that the current input terminal Iin is omitted from the configuration shown in FIG. 4 may be used. That is, in the invention, it is enough if only each of a plurality of terminal groups T includes at least an input terminal and an output terminal, and the number of input terminal or output terminals constituting a terminal group T or which of the voltage signal and the current signal is input to the respective terminals can be changed arbitrarily.

Modified Example 2

Figure 10:
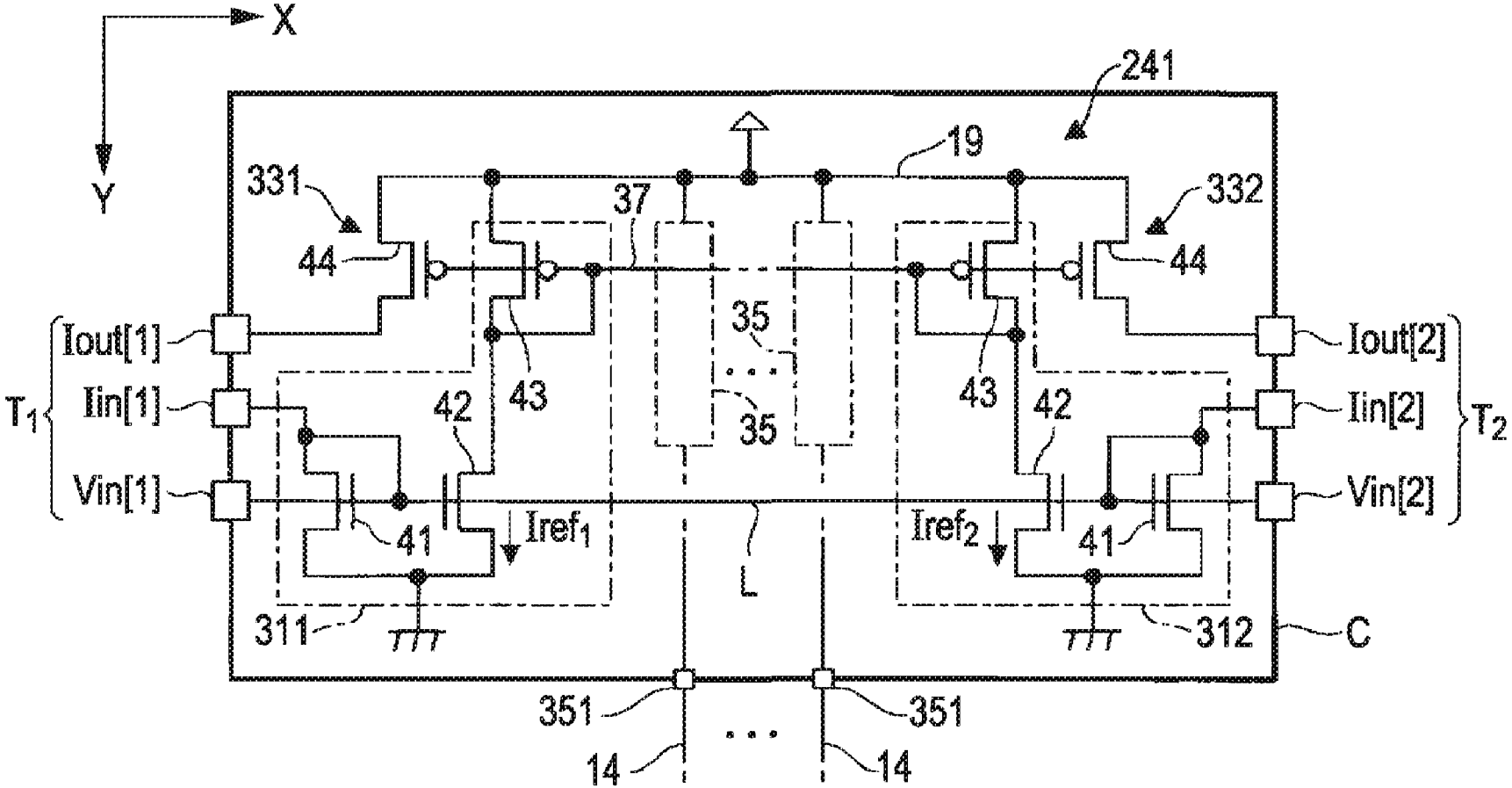
FIG. 10 is a block diagram illustrating a configuration of an electro-optical device according to a modified example.

As shown in FIG. 10, a configuration that the gates of the first transistor 41 and the second transistor 42 of the first current generator 311 and the gates of the first transistor 41 and the second transistor 49 of the second current generator 312 are electrically connected to each other through a wire L may be employed. According to this configuration, it is possible to rapidly and surely equalize the reference current Iref1 generated from the first current generator 311 and the reference current Iref2 generated from the second current generator 312.

Modified Example 3

Figure 11:
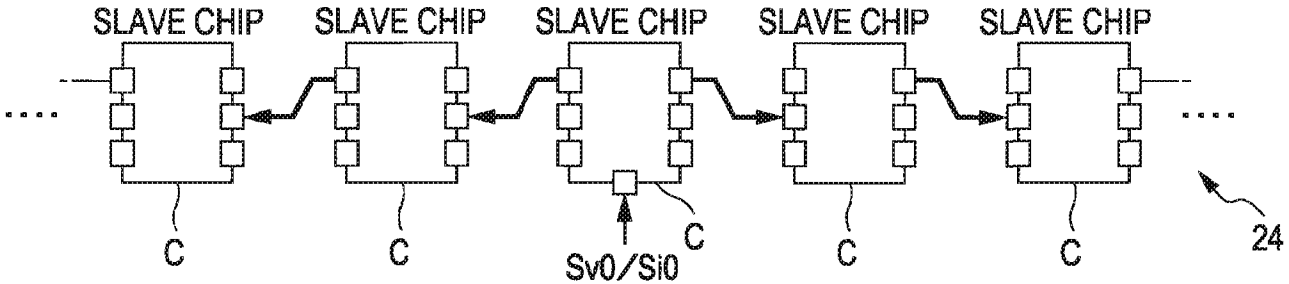
FIG. 11 is a block diagram illustrating another example of the arrangement of the semiconductor chips.

In FIGS. 6 and 7, the configuration that the semiconductor chips C positioned on the ends in the X direction serve as the master chip has been exemplified, but the position of the master chip can be arbitrarily changed. For example, as shown in FIG. 11, a configuration that the semiconductor chip C positioned at the center serves as the master chip with supply of the voltage signal Sv0 or the current signal Si0 may be employed. As shown in FIG. 11, in the invention, all the semiconductor chips C (driving circuits 241) constituting the data-line driving circuit 24 may not necessarily have the same configuration, and the total number of terminal groups T formed in one semiconductor chip C may be changed arbitrarily.

Modified Example 4

The structures of the respective parts for driving the electro-optical elements 17 with predetermined gray scales can be changed. For example, the first example and the second example described below can be employed.

First Example of Modified Example 4

Figure 12:
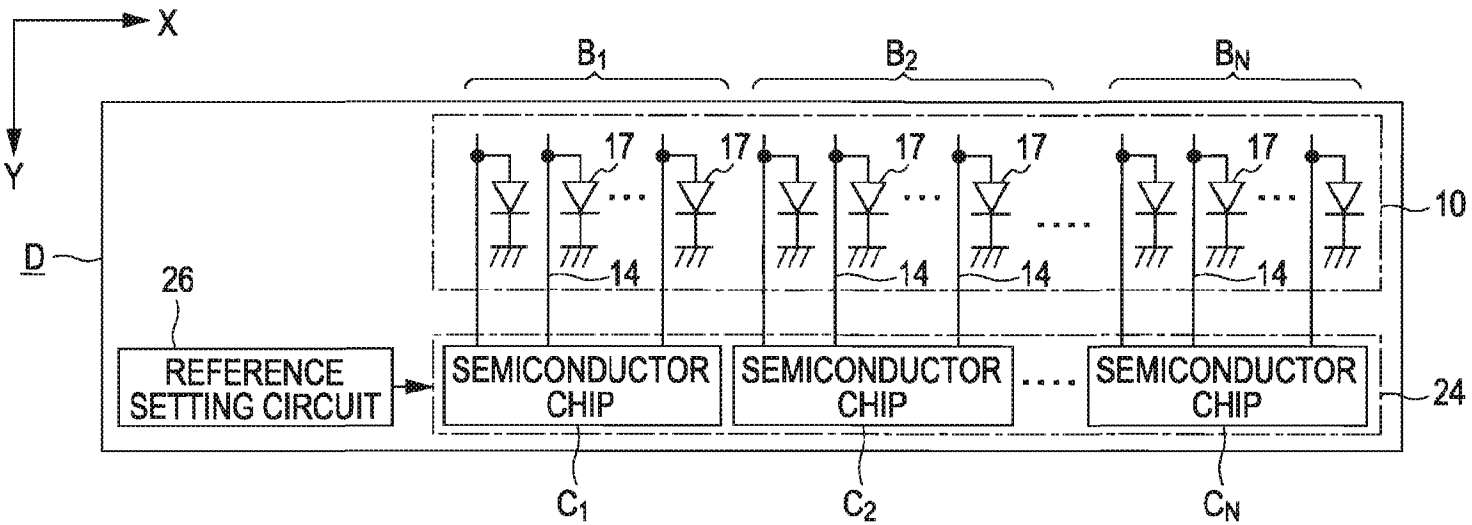
FIG. 12 is a block diagram illustrating a configuration of an electro-optical device used as an exposing device.

FIG. 12 is a block diagram illustrating an example when the invention is applied to an exposing head (line head) of a printer. As shown in the figure, in the first example, a plurality of electro-optical elements 17 is arranged in the X direction (that is, in the primary scan direction of a recording material such as paper). Accordingly, in the first example, the scanning lines 12 and the scanning-line driving circuit 22 shown in FIG. 1 are not provided. As shown in FIG. 12, the positive electrodes of the electro-optical elements 17 are connected to the data lines 14 and the negative electrodes of the electro-optical elements 17 are connected in common to the ground line. In the configuration described above, the data signals corresponding to the gray-scale data G are sequentially output to the data lines 14 from the data-line driving circuit 24 thereby controlling the electro-optical elements 17 with the gray scales corresponding to the gray-scale data G. In this way, the scanning lines 12 and the scanning-line driving circuit 22 are not essential elements to the invention.

Second Example of Modified Example 4

Figure 13:
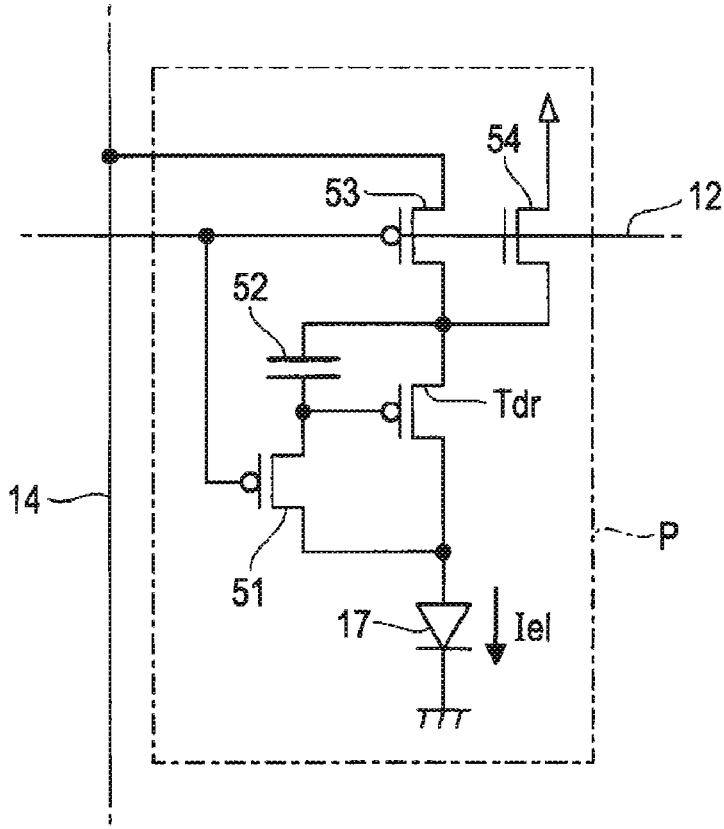
FIG. 13 is a circuit diagram illustrating a configuration of a pixel circuit of an electro-optical device according to a modified example.

The invention can be applied to an active matrix electro-optical device D in which a pixel circuit for controlling the gray scale of each electro-optical element 17 is formed for each electro-optical element 17. FIG. 13 is a circuit diagram illustrating a specific example of a pixel circuit P. The pixel circuits P shown in the figure are arranged in a matrix shape so that they correspond to the intersections between the scanning lines 12 and the data lines 14 shown in FIG. 1.

A p-channel driving transistor Tdr shown in FIG. 13 is an element for controlling current Iel supplied to the electro-optical element 17. In each electro-optical element 17, the positive electrode is connected to the drain of the driving transistor Tdr and the negative electrode is connected to the ground line. A p-channel transistor 51 is interposed between the gate and the drain of the driving transistor Tdr and a capacitive element 52 is interposed between the gate and the source of the driving transistor Tdr. The source of the driving transistor Tdr is connected to the drain of a p-channel selection transistor 53. The selection transistor 53 is an element for switching the electrical connection between the source of the driving transistor Tdr and the data line 14, and the source thereof is connected to the data line 14. An n-channel transistor 54 is interposed between the source and the power supply line of the driving transistor Tdr. The gates of the transistor 51, the selection transistor 53, and the transistor 54 are connected in common to the scanning line 12.

In this configuration, when the scanning line 12 is set to a low level in the horizontal scanning period, the transistor 51 is turned on and the driving transistor Tdr forms diode connection. In addition, the selection transistor 53 is turned on and the source of the driving transistor Tdr is connected to the data line 14. Accordingly, the data signal passes through the driving transistor Tdr, and the gate-source voltage (that is, the voltage corresponding to the data signal) of the driving transistor Tdr is held by the capacitive element 52.

On the other hand, when the horizontal scanning period has passed and the scanning line 12 is set to a high level, the transistor 51 and the selection transistor 53 are changed to the OFF state, but the voltage held by the capacitive element 52 in the previous horizontal scanning period is continuously applied across the gate and source of the driving transistor Tdr. On the other hand, the transistor 54 is changed to the ON state by the scanning line 12 changed to the high level. Accordingly, the current Iel corresponding to the voltage of the capacitive element 52 (that is, the current corresponding to the data signal in the previous horizontal scanning period) is supplied from the power supply line through the transistor 54 and the driving transistor Tdr to the electro-optical device 17. The electro-optical element 17 emits light with the brightness corresponding to the current Iel.

Modified Example 5

Figure 14:
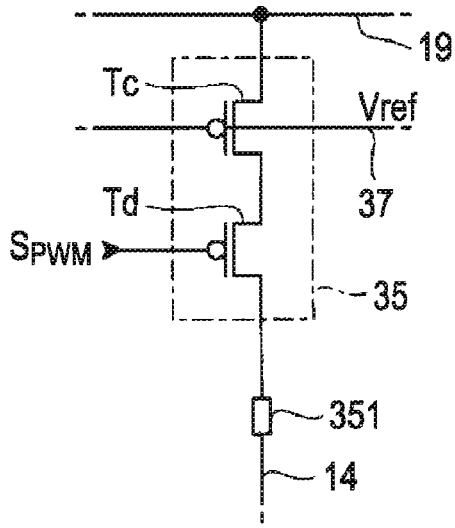
FIG. 14 is a circuit diagram illustrating another example of the data signal generator.

In the above-mentioned embodiment, the D/A converter for generating the data signals, which are analog current signals, from the digital gray-scale data G has been exemplified as the data signal generator, but the example of the data signal or the circuit configuration for generating the data signal is not limited to the example shown in FIG. 5. for example, as shown in FIG. 14, a data signal generator 35 for driving the electro-optical elements 17 in a pulse width modulation manner may be employed. A transistor Tc shown in the figure is a p-channel transistor of which the gate is connected to the reference potential line 37 and the source is connected to the power supply line 19. On the other hand, A transistor Td is a p-channel transistor for controlling the electrical connection between the drain of the transistor Tc and the data output terminal 351 (including the data line 14) in accordance with a signal SPWM. The signal SPWM is generated, for example, in accordance with the gray-scale data G so that the time density of the low level (that is, the level for turning on the transistor Td) becomes higher as the gray scale specified by the gray-scale data G becomes higher. In this configuration, the current corresponding to the potential Vref of the reference potential line 37 is selectively output to the data line 14 through the transistor Tc and the transistor Td in the period when the transistor Td is in the ON state. That is, the pulse signal with the time density corresponding to the gray-scale data G is output as the data signal. In this configuration, the electro-optical elements 17 are controlled into the gray scales corresponding to the gray-scale data G (for example, the brightness corresponding to the time density of the data signals). The data signal generator 35 shown in FIG. 14 is particularly suitable for the configuration that the data signals of the data lines 14 are supplied directly to the electro-optical elements 17.

Modified Example 6

In the above-mentioned embodiments, the electro-optical device D employing the OLED elements have been exemplified, but the invention can be applied to electro-optical devices employing other electro-optical elements. For example, the invention can be applied to a variety of light emitting devices such as a display device employing inorganic EL elements, a field emission display (FED), a surface-conduction electron-emitter display (SED), a ballistic electron surface emitting display (BSD), a display device employing light emitting diodes.

D: Applications

Figure 15:
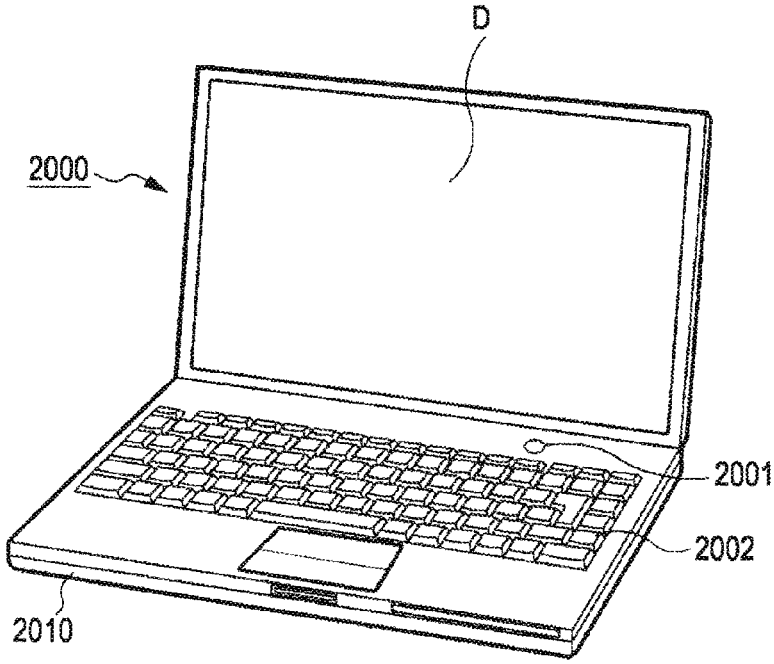
FIG. 15 is a perspective view illustrating a specific example of an electronic apparatus according to the invention.

An electronic apparatus employing the light emitting device according to the invention is described now. FIG. 15 is a perspective view illustrating a configuration of a mobile personal computer employing the light emitting device D according to any one embodiment described above as a display unit. The personal computer 2000 includes the light emitting device D as a display unit and a main body 2010. The main body 2010 is provided with a power supply switch 2001 and a keyboard 2002. Since the OLED elements are used as the light emitting elements 17 of the electro-optical device D, it is possible to display an image with a wide viewing angle and excellent visibility.

Figure 16:
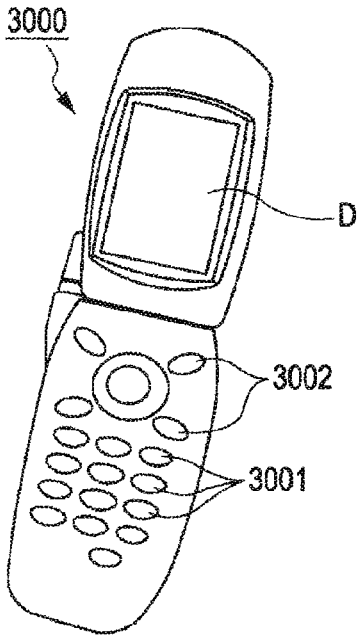
FIG. 16 is a perspective view illustrating another specific example of the electronic apparatus according to the invention.

FIG. 16 illustrates a configuration of a mobile phone employing the light emitting device D according to the above-mentioned embodiments. The mobile phone 3000 includes plurality of operation buttons 3001 and scroll buttons 3002 and a light emitting device D as a display unit. An image displayed on the light emitting device D is scrolled by operating the scroll buttons 3002.

Figure 17:
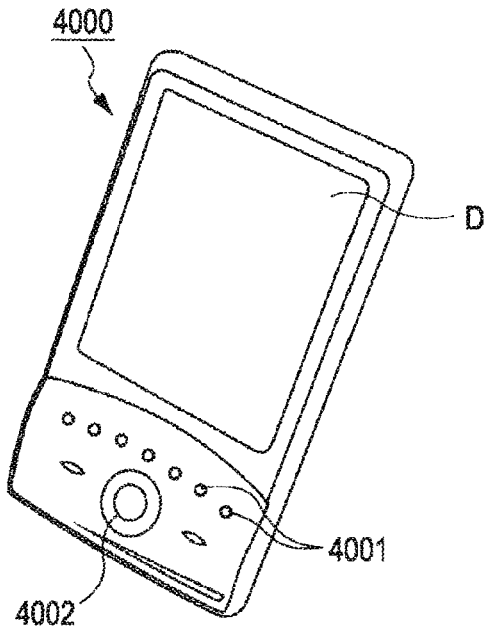
FIG. 17 is a perspective view illustrating another specific example of the electronic apparatus according to the invention.

FIG. 17 illustrates a configuration of a personal digital assistant (PDA) employing the light emitting device D according to the above-mentioned embodiments. The personal digital assistant 4000 includes a plurality of operation buttons 4001, a power supply switch 4002, and a light emitting device D as a display unit. Information such as an address list or a schedule book is displayed on the light emitting device D by operating the power supply switch 4002.

In addition to those shown in FIGS. 15 to 17, examples of the electronic apparatus employing the light emitting device according to the invention can include a digital still camera, a television, a video camera, a car navigation apparatus, a pager, an electronic pocketbook, an electronic paper, an electronic calculator, a word processor, a work station, a television phone, a POS terminal, a printer, a scanner, a copier, a video player, an apparatus having a touch panel, and the like. The application of the electro-optical device according to the invention is not limited to displaying an image. For example, a writing head for exposing a photosensitive drum to correspond to the image to be formed on a recording material such as paper is used in an image forming apparatus such as an optical writing printer or an electronic copier, and the electro-optical device (specifically, the example shown in FIG. 12) according to the invention can be used as such a writing head.

What is claimed is:

1. A driving circuit of an electro-optical device that has an electro-optical element, the electro-optical element emitting a brightness that is responsive to a data signal, the driving circuit comprising:

a first terminal group and a second terminal group, each of the first and second terminal groups including an input terminal and an output terminal, each terminal in the first terminal group and the second terminal group being an input or an output of a semiconductor chip;

a first current generator that generates a first reference current in response to a reference potential and a first input signal provided to the input terminal of the first terminal group, the first current generator including a current mirror circuit having a transistor that generates a first current that is responsive to the first input signal provided to the input terminal of the first terminal group, and a transistor that generates a mirror current of the first current as the first reference current;

a second current generator that generates a second reference current in response to the reference potential and a second input signal provided to the input terminal of the second terminal group, the second current generator including a current mirror circuit having a transistor that generates a second current that is responsive to the second input signal provided to the input terminal of the second terminal group, and a transistor that generates a mirror current of the second current as the second reference current;

a data signal generator that generates the data signal using, as a reference, the reference potential, which is generated in response to the first reference current and the second reference current;

a first output unit that outputs a first output signal, based on the reference potential that is responsive to the first reference current and the second reference current, to the output terminal of the first terminal group, the first output signal being an output from a drain of a transistor directly connected to the output terminal of the first terminal group without any other passive or active components connected between the drain of the transistor and the output terminal of the first terminal group; and a second output unit that outputs a second output signal, based on the reference potential that is responsive to the first reference current and the second reference current, to the output terminal of the second terminal group along with the output of the first output signal, the second output signal being an output from a drain of a transistor directly connected to the output terminal of the second terminal group without any other passive or active components connected between the drain of the transistor and the output terminal of the second terminal group, wherein the input terminal of the second terminal group is connected to the output terminal of the first terminal group of an adjacent driving circuit and the output terminal of the second terminal group is connected to the input terminal of the first terminal group of the adjacent driving circuit.

2. The driving circuit according to claim 1, the driving circuit being integrated on a semiconductor chip; and the respective terminals of the first terminal group being disposed on one side of the data signal generator, and the respective terminals of the second terminal group being disposed on an opposite side of the data signal generator.

3. The driving circuit according to claim 1, the first current generator including a first voltage generating transistor disposed in a path of the first reference current, a gate of the first voltage generating transistor being connected to a reference potential line, the second current generator including a second voltage generating transistor disposed in a path of the second reference current, a gate of the second voltage generating transistor being connected to the reference potential line, and the data signal generator generating the data signal using a potential of the reference potential line as a reference.

4. The driving circuit according to claim 1, gates of the transistors that constitute the current mirror circuit of the first current generator being connected to gates of the transistors that constitute the current mirror circuit of the second current generator.

5. The driving circuit according to claim 1, each of the first terminal group and the second terminal group including, as the input terminal, at least one of a terminal to which a current signal is input or a terminal to which a voltage signal is input, and the output terminal being a terminal that outputs a current signal.

6. An electro-optical device, comprising:

a plurality of electro-optical elements that are placed in optical states responsive to data signals supplied to data lines;

a data-line driving circuit in which a plurality of the driving circuits according to claim 1 are arranged; and a first wire that connects the output terminal of the first terminal group of each driving circuit to the input terminal of the second terminal group of another driving circuit adjacent to the driving circuit.

7. The electro-optical device according to claim 6, further comprising a second wire that connects the input terminal of the first terminal group of each driving circuit to the output terminal of the second terminal group of another driving circuit adjacent to the driving circuit.

8. The electro-optical device according to claim 6, each of the plurality of driving circuits being integrated in a semiconductor chip and arranged in a predetermined direction, and in each semiconductor chip, each terminal of the first terminal group being disposed on one side in the predetermined direction, and each terminal of the second terminal group being disposed on the other side in the predetermined direction.

9. The electro-optical device according to claim 6, further comprising:

a reference setting unit that generates a voltage signal that serves as a reference for each reference current, the voltage signal generated by the reference setting unit being supplied to the input terminal of at least one driving circuit among the plurality of driving circuits.

10. The electro-optical device according to claim 6, further comprising:

a reference setting unit that generates a current signal that serves as a reference for each reference current, the current signal generated by the reference setting unit being supplied to the input terminal of at least one driving circuit among the plurality of driving circuits.

11. An electronic apparatus, comprising:

the electro-optical device according to claim 6.

12. A driving circuit of an electro-optical device that has an electro-optical element, the electro-optical element emitting a brightness that is responsive to a data signal, the driving circuit comprising:

a first terminal group and a second terminal group, each of the first and second terminal groups including an input terminal and an output terminal, each terminal in the first terminal group and the second terminal group being an input or an output of a semiconductor chip;

a first current generator that generates a first reference current in response to a reference potential and a first input signal provided to the input terminal of the first terminal group, the first current generator including a current mirror circuit having a transistor that generates a first current that is responsive to the first input signal provided to the input terminal of the first terminal group, and a transistor that generates a mirror current of the first current as the first reference current;

a second current generator that generates a second reference current in response to the reference potential and a second input signal provided to the input terminal of the second terminal group, the second current generator including a current mirror circuit having a transistor that generates a second current that is responsive to the second input signal provided to the input terminal of the second terminal group, and a transistor that generates a mirror current of the second current as the second reference current;

a data signal generator that generates the data signal using, as a reference, the reference potential, which is generated in response to the first reference current and the second reference current;

a first output unit that outputs a first output signal, based on the reference potential that is responsive to the first reference current and the second reference current, to the output terminal of the first terminal group, the first output signal being an output from a drain of a transistor directly connected to the output terminal of the first terminal group without any other passive or active components connected between the drain of the transistor and the output terminal of the first terminal group; and a second output unit that outputs a second output signal, based on the reference potential that is responsive to the first reference current and the second reference current, to the output terminal of the second terminal group along with the output of the first output signal, the second output signal being an output from a drain of a transistor directly connected to the output terminal of the second terminal group without any other passive or active components connected between the drain of the transistor and the output terminal of the second terminal group, wherein the input terminal of the first terminal group is connected to the output terminal of the second terminal group of a first adjacent driving circuit and the input terminal of the second terminal group is connected to the output terminal of the first terminal group of a second adjacent driving circuit.

13. A driving circuit of an electro-optical device that has an electro-optical element, the electro-optical element emitting a brightness that is responsive to a data signal, the driving circuit comprising:

a first terminal group and a second terminal group, each of the first and second terminal groups including an input terminal and an output terminal, each terminal in the first terminal group and the second terminal group being an input or an output of a semiconductor chip;

a first current generator that generates a first reference current in response to a reference potential and a first input signal provided to the input terminal of the first terminal group, the first current generator including a current mirror circuit having a transistor that generates a first current that is responsive to the first input signal provided to the input terminal of the first terminal group, and a transistor that generates a mirror current of the first current as the first reference current;

a second current generator that generates a second reference current in response to the reference potential and a second input signal provided to the input terminal of the second terminal group, the second current generator including a current mirror circuit having a transistor that generates a second current that is responsive to the second input signal provided to the input terminal of the second terminal group, and a transistor that generates a mirror current of the second current as the second reference current;

a data signal generator that generates the data signal using, as a reference, the reference potential, which is generated in response to the first reference current and the second reference current;

a first output unit that outputs a first output signal, based on the reference potential that is responsive to the first reference current and the second reference current, to the output terminal of the first terminal group, the first output signal being an output from a drain of a transistor directly connected to the output terminal of the first terminal group without any other passive or active components connected between the drain of the transistor and the output terminal of the first terminal group; and a second output unit that outputs a second output signal, based on the reference potential that is responsive to the first reference current and the second reference current, to the output terminal of the second terminal group along with the output of the first output signal, the second output signal being an output from a drain of a transistor directly connected to the output terminal of the second terminal group without any other passive or active components connected between the drain of the transistor and the output terminal of the second terminal group, wherein the input terminal of the first terminal group is connected to the output terminal of the second terminal group of an adjacent driving circuit and the output terminal of the first terminal group is connected to the input terminal of the second terminal group of the adjacent driving circuit.

* * * * *